US012569002B2

(12) United States Patent
Abi Aoun et al.

(10) Patent No.: US 12,569,002 B2
(45) Date of Patent: Mar. 10, 2026

(54) METHOD OF MAKING AN AMORPHOUS SOLID FOR USE WITH A NON-COMBUSTIBLE AEROSOL PROVISION SYSTEM

(71) Applicant: NICOVENTURES TRADING LIMITED, London (GB)

(72) Inventors: Walid Abi Aoun, London (GB); Thomas Leah, London (GB); Barnaby Oakley, London (GB)

(73) Assignee: NICOVENTURES TRADING LIMITED, London (GB)

( * ) Notice: Subject to any disclaimer, the term of this patent is extended or adjusted under 35 U.S.C. 154(b) by 829 days.

(21) Appl. No.: 17/780,193

(22) PCT Filed: Nov. 27, 2020

(86) PCT No.: PCT/EP2020/083740

§ 371 (c)(1),
(2) Date: May 26, 2022

(87) PCT Pub. No.: WO2021/105431

PCT Pub. Date: Jun. 3, 2021

(65) Prior Publication Data

US 2022/0408790 A1 Dec. 29, 2022

(30) Foreign Application Priority Data

Nov. 29, 2019 (GB) ..... 1917481

(51) Int. Cl.
*A24B 15/28* (2006.01)
*A24B 15/167* (2020.01)

(52) U.S. Cl.
CPC ..... *A24B 15/167* (2016.11); *A24B 15/28* (2013.01)

(58) Field of Classification Search
CPC ..... A24B 15/28
See application file for complete search history.

(56) References Cited

U.S. PATENT DOCUMENTS 4,506,684 A * 3/1985 Keritsis ..... A24B 15/16 162/158
2013/0319430 A1* 12/2013 Tanaka ..... A24B 15/10 427/374.3
2017/0273346 A1* 9/2017 Klipfel ..... A24B 15/14
2018/0279666 A1* 10/2018 Aoun ..... A24B 15/32
2018/0310609 A1* 11/2018 Deforel ..... A24B 15/167
2019/0142058 A1* 5/2019 Klipfel ..... A24B 3/14 131/370

FOREIGN PATENT DOCUMENTS

| | | | |
|---|---|---|---|
| RU | 2675474 | C1 | 12/2018 |
| WO | 2015062983 | A2 | 5/2015 |
| WO | WO-2016050471 | A1 | 4/2016 |
| WO | 2016135331 | A1 | 9/2016 |
| WO | 2016184977 | A1 | 11/2016 |
| WO | WO-2017041920 | A1 | 3/2017 |
| WO | WO-2017077112 | A1 | 5/2017 |
| WO | WO-2017202538 | A1 | 11/2017 |
| WO | WO-2017207161 | A1 | 12/2017 |
| WO | 2018122070 | A1 | 7/2018 |
| WO | WO-2018122097 | A1 | 7/2018 |
| WO | 2018178290 | A2 | 10/2018 |
| WO | 2020025701 | A1 | 2/2020 |
| WO | 2020074494 | A1 | 4/2020 |

OTHER PUBLICATIONS

International Search Report and Written Opinion for Application No. PCT/EP2020/083740, mailed on Mar. 1, 2021, 13 pages.

* cited by examiner

*Primary Examiner* — Cynthia Szewczyk

(74) *Attorney, Agent, or Firm* — WOMBLE BOND DICKINSON (US) LLP

(57) ABSTRACT

An amorphous solid and related method of making including (a) forming a slurry having 0.5-60 wt % of a gelling agent; 5-80 wt % of an aerosol forming material; and 0-60 wt % of an active constituent and/or flavorant; wherein these weights are calculated on a dry weight basis; (b) shaping the slurry on a support material, wherein the slurry has a bottom surface proximal to the support material, and a top surface opposite the bottom surface; (c) setting the slurry to form a gel with bottom and top surfaces corresponding to the bottom and top surfaces of the slurry; and (d) drying the gel to form an amorphous solid; wherein the drying includes a first period of supplying heat to the bottom surface of the gel and a second period of supplying heat to the top surface of the gel.

15 Claims, 5 Drawing Sheets

METHOD OF MAKING AN AMORPHOUS SOLID FOR USE WITH A NON-COMBUSTIBLE AEROSOL PROVISION SYSTEM

The present application is a National Phase entry of PCT Application No. PCT/EP2020/083740, filed Nov. 27, 2020, which claims priority from GB Patent Application No. 1917481.2, filed Nov. 29, 2019, all of which are hereby fully incorporated herein by reference.

TECHNICAL FIELD

The present invention relates to methods of making an amorphous solid, the amorphous solid obtainable or obtained by said methods, and articles and systems incorporating said amorphous solid.

BACKGROUND

Smoking articles such as cigarettes, cigars and the like burn tobacco during use to create tobacco smoke. Alternatives to these types of articles release an inhalable aerosol or vapor by releasing compounds from a substrate material by heating without burning. These may be referred to as non-combustible smoking articles or aerosol generating assemblies.

One example of such a product is a heating device which release compounds by heating, but not burning, a solid aerosol-generating material. This solid aerosol-generating material may, in some cases, contain a tobacco material. The heating volatilizes at least one component of the material, typically forming an inhalable aerosol. These products may be referred to as heat-not-burn devices, tobacco heating devices or tobacco heating products. Various different arrangements for volatilizing at least one component of the solid aerosol-generating material are known.

As another example, there are hybrid devices. These hybrid devices contain a liquid source (which may or may not contain nicotine) which is vaporised by heating to produce an inhalable vapor or aerosol. The device additionally contains a solid aerosol-generating material (which may or may not contain a tobacco material) and components of this material are entrained in the inhalable vapor or aerosol to produce the inhaled medium.

SUMMARY

A first aspect of the invention provides a method of making an amorphous solid comprising:

(a) forming a slurry comprising:
  0.5-60 wt % of a gelling agent; and
  5-80 wt % of an aerosol forming material;
  0-60 wt % of an active constituent and/or flavorant;
wherein these weights are calculated on a dry weight basis;
(b) shaping the slurry on a support material, wherein the slurry has a bottom surface proximal to the support material, and a top surface opposite the bottom surface;
(c) setting the slurry to form a gel with bottom and top surfaces corresponding to the bottom and top surfaces of the slurry; and
(d) drying the gel to form an amorphous solid;
wherein the drying comprises a first period of supplying heat to the bottom surface of the gel and a second period of supplying heat to the top surface of the gel.

The inventors have established that drying the gel from both sides generates an amorphous solid with a desired water content, whilst minimising the formation of cracks in the amorphous solid. It also reduces delamination of the gel and/or the amorphous solid from the support material during drying, which improves the consistency of the claimed method.

A second aspect of the invention provides a method of making an amorphous solid comprising:

(a) forming a slurry comprising:
  0.5-60 wt % of a gelling agent; and
  5-80 wt % of an aerosol forming material;
  0-60 wt % of an active constituent and/or flavorant;
wherein these weights are calculated on a dry weight basis;
(b) shaping the slurry on a thermally-conductive support material;
(c) setting the slurry to form a gel; and
(d) drying the gel to form an amorphous solid;
wherein the drying comprises heating the thermally-conductive support material.

The inventors have established that drying the gel from the underside using a thermally-conductive support material helps to generate an amorphous solid with a desired water content, whilst minimizing the formation of cracks in the amorphous solid. It also reduces delamination of the gel and/or the amorphous solid from the support during drying, which improves the consistency of the claimed method.

A third aspect of the invention provides an amorphous solid obtainable or obtained by methods of the first or second aspect.

A fourth aspect of the invention provides an article for use within a non-combustible aerosol provision system, the article comprising an amorphous solid according to the third aspect. The article may be referred to herein as an aerosol generating article.

A fifth aspect of the invention provides a non-combustible aerosol provision system comprising the article according to the fourth aspect and a non-combustible aerosol provision device, the non-combustible aerosol provision device comprising an aerosol-generation device to generate aerosol from the article when the article is used with the non-combustible aerosol provision device. In some cases, the device may comprise a heater which is configured to heat the amorphous solid, without burning. In some cases, the system may be referred to herein as an aerosol generating assembly.

Further features and advantages of the invention will become apparent from the following description, given by way of example only, and with reference to the accompanying figures.

DETAILED DESCRIPTION

Figure 1:
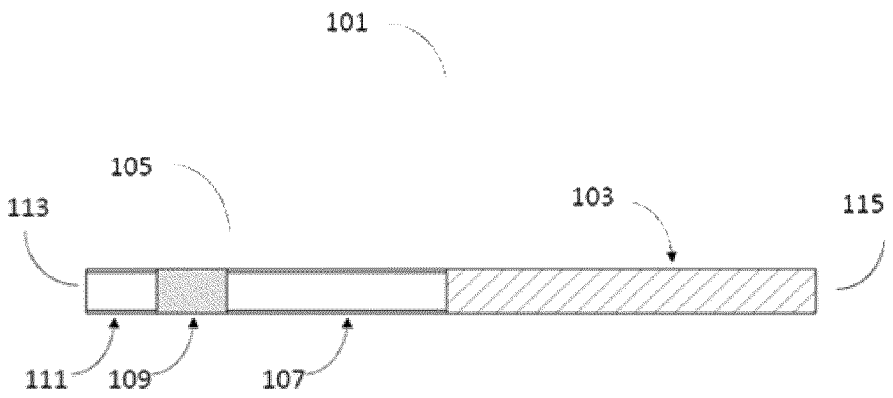
FIG. 1 shows a section view of an example of an article.

The method described herein generates an "amorphous solid", which may alternatively be referred to as a "monolithic solid" (i.e. non-fibrous), or as a "dried gel". The amorphous solid is a solid material that may retain some fluid, such as liquid, within it.

As described above, the invention provides a method of making an amorphous solid comprising:

(a) forming a slurry comprising:
0.5-60 wt % of a gelling agent; and
5-80 wt % of an aerosol forming material;
0-60 wt % of an active constituent and/or flavorant;
wherein these weights are calculated on a dry weight basis;
(b) shaping the slurry on a support material, wherein the slurry has a bottom surface proximal to the support material, and a top surface opposite the bottom surface;
(c) setting the slurry to form a gel with bottom and top surfaces corresponding to the bottom and top surfaces of the slurry; and
(d) drying the gel to form an amorphous solid;
wherein the drying comprises a first period of supplying heat to the bottom surface of the gel and a second period of supplying heat to the top surface of the gel.

The first and second periods may occur sequentially or simultaneously. Moreover, the terms "first" and "second" do not imply any chronological order. These terms are simply used to provide references to the respective periods.

In some cases, the support material is a thermally-conductive support material, and wherein the first period comprises heating the thermally-conductive support material to at least 100° C. In some such cases, the thermally-conductive support material is a metallic band.

In some cases, the second period comprises flowing air over the gel, wherein the air temperature is in the range of about 80° C. to about 140° C., for a period of less than 60 minutes. In some cases, the air flow speed is less than about 30 m/s, and is suitably in the range of 10 m/s to 30 m/s. In some cases, the air flow speed is about 20 m/s. In some cases, the second period comprises flowing air over the gel for less than about 40 minutes, 30 minutes or 20 minutes. In some cases, it comprises heating the gel for at least about 10 minutes. In some cases, the air temperature is in the range of about 80° C., 85° C. or 90° C. to about 130° C., 120° C. or 110° C.

In some cases, the drying (d) comprises (di) a first period of supplying heat to the bottom surface of the gel, (dii) a second period of supplying heat to the top surface of the gel, and (diii) a third period of supplying heat to the bottom surface of the gel, wherein (di) and (dii) occur simultaneously or sequentially and (diii) occurs after (dii) has concluded. In some cases, there are three drying zones corresponding to (di), (dii) and (diii), and the gel is moved between the zones over time. In particular, the support material may be a band which is driven over rollers, thereby moving the gel between zones.

In some such cases, the support material is a thermally-conductive support material and the first and third periods comprise heating the thermally-conductive support material to at least 100° C.; and the second period comprises flowing hot air over the gel as described above.

In some cases, the thermally-conductive support material may be heated by contact with hot air/steam, for example (where that air/steam does not contact the gel). In other cases, the thermally-conductive support material may be such that it is heated on application on an electric current.

The invention also provides a method of making an amorphous solid comprising:

(a) forming a slurry comprising:
0.5-60 wt % of a gelling agent; and
5-80 wt % of an aerosol forming material;
0-60 wt % of an active constituent and/or flavorant;
wherein these weights are calculated on a dry weight basis;
(b) shaping the slurry on a thermally-conductive support material;
(c) setting the slurry to form a gel; and
(d) drying the gel to form an amorphous solid;
wherein the drying comprises heating the thermally-conductive support material.

In some cases, the thermally-conductive support material is heated to at least 100° C.

In some cases, the drying (d) additionally comprises flowing air over the gel, wherein the air temperature is in the range of about 80° C. to about 140° C. for a period of less than 60 minutes. In some cases, the air flow speed is less than about 30 m/s, and is suitably in the range of 10 m/s to 30 m/s. In some cases, the air flow speed is about 20 m/s. In some cases, the second period comprises flowing air over the gel for less than about 40 minutes, 30 minutes or 20 minutes. In some cases, it comprises heating the gel for at least about 10 minutes. In some cases, the air temperature is in the range of about 80° C., 85° C. or 90° C. to about 130° C., 120° C. or 110° C.

In some cases, the thermally-conductive support material may be heated by contact with hot air/steam, for example (where that air/steam does not contact the gel). In other cases, the thermally-conductive support material may be such that it is heated on application on an electric current.

In some cases, the drying (d) comprises (di) heating the thermally-conductive support material to at least about 100° C., (dii) flowing air over the gel, wherein the air temperature is in the range of about 80° C. to about 140° C., and (diii) heating the thermally-conductive support material to at least about 100° C., wherein (di) and (dii) occur simultaneously or sequentially and (diii) occurs after (dii) has concluded. In some cases, there are three drying zones corresponding to (di), (dii) and (diii), and the gel is moved between the zones over time. In particular, the support material may be a band which is driven over rollers, thereby moving the gel between zones.

In some cases, the drying (d) may, in some cases, remove from about 50 wt %, 60 wt %, 70 wt %, 80 wt % or 90 wt % to about 80 wt %, 90 wt % or 95 wt % (WWB) of water in the slurry.

In some cases, the resulting amorphous solid comprises from about 1 wt % to about 15 wt % water, calculated on a wet weight basis. Suitably, the resulting amorphous solid comprises from about 5 wt % to about 15 wt % water, calculated on a wet weight basis (WWB). Suitably, the water content of the amorphous solid may be from about 5 wt %, 7 wt % or 9 wt % to about 15 wt %, 13 wt % or 11 wt % (WWB), most suitably about 10 wt %.

The inventors have established that the drying process is important as it controls the final water content of amorphous solid. In particular, if the water content of the amorphous solid is too high, its performance in use is compromised. The high heat capacity of water means that if the water content is too high, more energy is needed to generate an aerosol, reducing operating efficiency. Further, if the water content is too high, the puff profile may be less satisfactory to the consumer due to the generation of hot and humid puffs (a sensation known in the field as "hot puff"). Moreover, if the water content is too high, microbial growth may occur. Conversely, if the water content is too low, the material may be brittle and difficult to handle. The hygroscopic nature of the aerosol forming material may mean that water is drawn into the material from the atmosphere if the water content is too low, destabilising the material.

The inventors have also established that if the drying process occurs too quickly, the amorphous solid has been observed to crack. The aerosol generated from a cracked amorphous solid on heating is less consistent as compared to a solid that is not cracked. The drying process is therefore important as it affects the aerosol generation and user satisfaction.

Further, the inventors have established that if the drying temperature is too high, the content of desired components (e.g. the aerosol forming material, active constituent and/or flavorant) of the amorphous solid may be reduced beyond desired levels.

Thus, there are a number of competing objectives that must be balanced when attempting to dry the gel to form an amorphous solid. The claimed processes have been found by the inventors to be particularly suitable.

In some cases, the drying results in an amorphous solid which has a thickness that is between about 5% and 20% of the slurry thickness, suitably about 10%. In some cases, the amorphous solid may have a thickness of about 0.015 mm to about 1.0 mm. Suitably, the thickness may be in the range of about 0.05 mm, 0.1 mm or 0.15 mm to about 0.5 mm or 0.3 mm. The inventors have found that a material having a thickness of 0.2 mm is particularly suitable. The amorphous solid may comprise more than one layer, and the thickness described herein refers to the aggregate thickness of those layers.

In some cases, the method comprises forming a layer of the slurry which is less than about 4 mm thick. Suitably, the thickness of the slurry layer is in the range of about 1 mm to about 3 mm, suitably about 1.5 mm to about 2.5 mm. In some cases, the thickness of the slurry layer is about 2 mm.

The inventors have found that if the slurry layer is too thick, it can be difficult to dry to form an amorphous solid with the required water content, whilst minimising cracking of the solid on drying.

The inventors have established that if the aerosol-forming amorphous solid is too thick, then heating efficiency is compromised. This adversely affects the power consumption in use. Conversely, if the aerosol-forming amorphous solid is too thin, it is difficult to manufacture and handle; a very thin material is harder to cast and may be fragile, compromising aerosol formation in use.

The inventors have established that the amorphous solid thicknesses stipulated herein optimise the material properties in view of these competing considerations.

Any thickness stipulated herein is a mean thickness. In some cases, the thickness may vary by no more than 25%, 20%, 15%, 10%, 5% or 1%.

In some cases, the surface temperature of the gel during drying does not exceed about 100° C.

The setting the gel may comprise the addition of a setting agent to the slurry. For example, the slurry may comprise sodium, potassium or ammonium alginate as a gelling agent, and a setting agent comprising a calcium source (such as calcium chloride or calcium lactate), may be added to the slurry to form a calcium alginate gel. In some cases, the setting agent may be sprayed onto the slurry after (b).

In examples, the setting agent comprises or consists of calcium acetate, calcium formate, calcium carbonate, calcium hydrogencarbonate, calcium chloride, calcium lactate, or a combination thereof. In some examples, the setting agent comprises or consists of calcium formate and/or calcium lactate. In particular examples, the setting agent comprises or consists of calcium formate. The inventors have identified that, typically, employing calcium formate as a setting agent results in an amorphous solid having a greater tensile strength and greater resistance to elongation.

The total amount of the setting agent, such as a calcium source, may be 0.5-5 wt % (calculated on a dry weight basis). Suitably, the total amount may be from about 1 wt %, 2.5 wt % or 4 wt % to about 4.8 wt % or 4.5 wt %. The inventors have found that the addition of too little setting agent may result in an amorphous solid which does not stabilise the amorphous solid components and results in these components dropping out of the amorphous solid. The inventors have found that the addition of too much setting agent results in an amorphous solid that is very tacky and consequently has poor handleability.

When the amorphous solid does not contain tobacco, a higher amount of setting agent may need to be applied. In some cases the total amount of setting agent may therefore be from 0.5-12 wt % such as 5-10 wt %, calculated on a dry weight basis. Suitably, the total amount may be from about 5 wt %, 6 wt % or 7 wt % to about 12 wt % or 10 wt %. In this case the amorphous solid will not generally contain any tobacco.

Alginate salts are derivatives of alginic acid and are typically high molecular weight polymers (10-600 kDa). Alginic acid is a copolymer of β-D-mannuronic (M) and α-L-guluronic acid (G) units (blocks) linked together with (1,4)-glycosidic bonds to form a polysaccharide. On addition of calcium cations, the alginate crosslinks to form a gel. The inventors have determined that alginate salts with a high G monomer content more readily form a gel on addition of the calcium source. In some cases therefore, the slurry may comprise an alginate salt in which at least about 40%, 45%, 50%, 55%, 60% or 70% of the monomer units in the alginate copolymer are α-L-guluronic acid (G) units.

In some examples, the slurry has a viscosity of from about 10 to about 20 Pa·s at 46.5° C., such as from about 14 to about 16 Pa·s at 46.5° C.

In some cases, the shaping the slurry may comprise spraying, casting or extruding the slurry, for example. In some cases, (b) may comprise forming a layer of the slurry. In some cases, the slurry layer is formed by casting the slurry.

In some cases, a carrier is provided and in (b), the slurry is shaped on the carrier. The carrier functions as a support on which the amorphous solid layer forms, easing manufacture. The carrier may provide rigidity to the amorphous solid layer, easing handling. The carrier may be any suitable material which can be used to support an amorphous solid. In some cases, the carrier may be formed from materials selected from metal foil, paper, carbon paper, greaseproof paper, ceramic, carbon allotropes such as graphite and graphene, plastic, cardboard, wood or combinations thereof. In some cases, the carrier may comprise or consist of a tobacco material, such as a sheet of reconstituted tobacco. In some cases, the carrier may be formed from materials selected from metal foil, paper, cardboard, wood or combinations thereof. In some cases, the carrier comprises paper. In some cases, the carrier itself be a laminate structure comprising layers of materials selected from the preceding lists. In some cases, the carrier may also function as a flavor carrier. For example, the carrier may be impregnated with a flavorant or with tobacco extract.

Suitably, the thickness of the carrier layer may be in the range of about 10 μm, 15 μm, 17 μm, 20 μm, 23 μm, 25 μm, 50 μm, 75 μm or 0.1 mm to about 2.5 mm, 2.0 mm, 1.5 mm, 1.0 mm or 0.5 mm. The carrier may comprise more than one layer, and the thickness described herein refers to the aggregate thickness of those layers.

In some cases, the carrier may be non-magnetic.

In some cases, the carrier may be magnetic. This functionality may be used to fasten the carrier to the assembly in use, or may be used to generate particular amorphous solid shapes. In some cases, the amorphous solid may comprise one or more magnets which can be used to fasten the solid to an induction heater in use.

In some cases, the carrier may be substantially or wholly impermeable to gas and/or aerosol. This prevents aerosol or gas passage through the carrier layer, thereby controlling the flow and ensuring it is delivered to the user. This can also be used to prevent condensation or other deposition of the gas/aerosol in use on, for example, the surface of a heater provided in an aerosol generating assembly. Thus, consumption efficiency and hygiene can be improved in some cases.

In some cases, the surface of the carrier that abuts the amorphous solid may be porous. For example, in one case, the carrier comprises paper. The inventors have found that a porous carrier such as paper is particularly suitable for the present invention; the porous (e.g. paper) layer abuts the amorphous solid layer and forms a strong bond. The amorphous solid is formed by drying a gel and, without being limited by theory, it is thought that the slurry from which the gel is formed partially impregnates the porous carrier (e.g. paper) so that when the gel sets and forms cross-links, the carrier is partially bound into the gel. This provides a strong binding between the gel and the carrier (and between the dried gel and the carrier).

Additionally, surface roughness may contribute to the strength of bond between the amorphous material and the carrier. The inventors have found that the paper roughness (for the surface abutting the carrier) may suitably be in the range of 50-1000 Bekk seconds, suitably 50-150 Bekk seconds, suitably 100 Bekk seconds (measured over an air pressure interval of 50.66-48.00 kPa). (A Bekk smoothness tester is an instrument used to determine the smoothness of a paper surface, in which air at a specified pressure is leaked between a smooth glass surface and a paper sample, and the time (in seconds) for a fixed volume of air to seep between these surfaces is the "Bekk smoothness".)

Conversely, the surface of the carrier facing away from the amorphous solid may be arranged in contact with the heater, and a smoother surface may provide more efficient heat transfer. Thus, in some cases, the carrier is disposed so as to have a rougher side abutting the amorphous material and a smoother side facing away from the amorphous material.

In one particular case, the carrier may be a paper-backed foil; the paper layer abuts the amorphous solid layer and the properties discussed in the previous paragraphs are afforded by this abutment. The foil backing is substantially impermeable, providing control of the aerosol flow path. A metal foil backing may also serve to conduct heat to the amorphous solid, both during drying and in use.

In another case, the foil layer of the paper-backed foil abuts the amorphous solid. The foil is substantially impermeable, thereby preventing water provided in the amorphous solid to be absorbed into the paper which could weaken its structural integrity.

In some cases, the carrier is formed from or comprises metal foil, such as aluminium foil. A metallic carrier may allow for better conduction of thermal energy to the amorphous solid, during drying and in use. Additionally, or alternatively, a metal foil may function as a susceptor in an induction heating system. In particular embodiments, the carrier comprises a metal foil layer and a support layer, such as cardboard. In these embodiments, the metal foil layer may have a thickness of less than 20 μm, such as from about 1 μm to about 10 μm, suitably about 5 μm.

In some cases, the carrier is the thermally-conductive support material described herein. In this case, the carrier must be thermally conductive. In some cases the carrier is formed from or comprises metal foil, such as aluminium foil, and is the thermally-conductive support material.

In some cases, the carrier may have a thickness of between about 0.017 mm and about 2.0 mm, suitably from about 0.02 mm, 0.05 mm or 0.1 mm to about 1.5 mm, 1.0 mm, or 0.5 mm.

In some cases, the slurry may comprise 1-60 wt % of a gelling agent wherein these weights are calculated on a dry weight basis. Suitably, the slurry may comprise from about 1 wt %, 5 wt %, 10 wt %, 15 wt %, 20 wt % or 25 wt % to about 60 wt %, 50 wt %, 45 wt %, 40 wt %, 35 wt %, 30 wt % or 27 wt % of a gelling agent (all calculated on a dry weight basis). For example, the slurry may comprise 1-50 wt %, 5-40 wt %, 10-30 wt % or 15-27 wt % of a gelling agent.

In some cases, the gelling agent comprises a hydrocolloid. In some cases, the gelling agent comprises one or more compounds selected from the group comprising alginates, pectins, starches (and derivatives), celluloses (and derivatives), gums, silica or silicones compounds, clays, polyvinyl alcohol and combinations thereof. For example, in some embodiments, the gelling agent comprises one or more of alginates, pectins, hydroxyethyl cellulose, hydroxypropyl cellulose, carboxymethylcellulose, pullulan, xanthan gum guar gum, carrageenan, agarose, acacia gum, fumed silica, PDMS, sodium silicate, kaolin and polyvinyl alcohol. In some cases, the gelling agent comprises alginate and/or pectin, and may be combined with a setting agent (such as a calcium source) during formation of the amorphous solid. In some cases, the amorphous solid may comprise a calcium-crosslinked alginate and/or a calcium-crosslinked pectin.

In some cases, the gelling agent comprises alginate, and the alginate is present in the amorphous solid in an amount of from 10-30 wt % of the amorphous solid (calculated on a dry weight basis). In some cases, alginate is the only gelling agent present in the amorphous solid. In other embodiments, the gelling agent comprises alginate and at least one further gelling agent, such as pectin.

In some cases, the slurry may include a gelling agent comprising carrageenan.

The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In preferred embodiments, the non-cellulose based gelling agent is alginate or agar.

Suitably, the amorphous solid may comprise from about 5 wt %, 10 wt %, 15 wt %, or 20 wt % to about 80 wt %, 70 wt %, 60 wt %, 55 wt %, 50 wt %, 45 wt % 40 wt %, or 35 wt % of an aerosol forming material (all calculated on a dry weight basis). The aerosol forming material may act as a plasticiser. For example, the slurry may comprise 10-60 wt %, 15-50 wt % or 20-40 wt % of an aerosol forming material. In some cases, the aerosol forming material comprises one or more compound selected from erythritol, propylene glycol, glycerol, triacetin, sorbitol and xylitol. In some cases, the aerosol forming material comprises, consists essentially of or consists of glycerol. The inventors have established that if the content of the plasticiser is too high, the amorphous solid may absorb water resulting in a material that does not create an appropriate consumption experience in use. The inventors have established that if the plasticiser content is too low, the amorphous solid may be brittle and easily broken. The plasticiser content specified herein provides an amorphous solid flexibility which allows the amorphous solid sheet to be wound onto a bobbin, which is useful in manufacture of articles used in aerosol generation.

In some embodiments, the aerosol forming material comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

In some cases, the slurry may comprise a flavor. Suitably, the amorphous solid may comprise up to about 60 wt %, 50 wt %, 40 wt %, 30 wt %, 20 wt %, 10 wt % or 5 wt % of a flavor flavour. In some cases, the amorphous solid may comprise at least about 0.5 wt %, 1 wt %, 2 wt %, 5 wt % 10 wt %, 20 wt % or 30 wt % of a flavor (all calculated on a dry weight basis). For example, the amorphous solid may comprise 0.1-60 wt %, 1-60 wt %, 5-60 wt %, 10-60 wt %, 20-50 wt % or 30-40 wt % of a flavor. In some cases, the flavor (if present) comprises, consists essentially of or consists of menthol. In some cases, the amorphous solid does not comprise a flavor.

In some cases, the slurry comprises an active constituent. For example, in some cases, the slurry additionally comprises a tobacco material and/or nicotine. For example, the slurry may additionally comprise powdered tobacco and/or nicotine and/or a tobacco extract. In some cases, the slurry may comprise from about 1 wt %, 5 wt %, 10 wt %, 15 wt %, 20 wt % or 25 wt % to about 60 wt %, 50 wt %, 45 wt % or 40 wt % (calculated on a dry weight basis) of active constituent. In some cases, the slurry may comprise from about 1 wt %, 5 wt %, 10 wt %, 15 wt %, 20 wt % or 25 wt % to about 60 wt %, 50 wt %, 45 wt % or 40 wt % (calculated on a dry weight basis) of a tobacco material and/or nicotine.

In some cases, the slurry comprises an active constituent such as tobacco extract. In some cases, the amorphous solid may comprise 5-60 wt % (calculated on a dry weight basis) of tobacco extract. In some cases, the slurry may comprise from about 1 wt %, 5 wt %, 10 wt %, 15 wt %, 20 wt % or 25 wt % to about 55 wt %, 50 wt %, 45 wt % or 40 wt % (calculated on a dry weight basis) tobacco extract. For example, the slurry may comprise 5-60 wt %, 10-55 wt % or 25-55 wt % of tobacco extract. The tobacco extract may contain nicotine at a concentration such that the slurry comprises 1 wt % 1.5 wt %, 2 wt % or 2.5 wt % to about 6 wt %, 5 wt %, 4.5 wt % or 4 wt % (calculated on a dry weight basis) of nicotine. In some cases, there may be no nicotine in the slurry other than that which results from the tobacco extract.

In some embodiments, the active constituent comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The active constituent may comprise one or more cannabinoid compounds selected from the group consisting of cannabidiol (CBD) and THC (tetrahydrocannabinol).

The active constituent may comprise cannabidiol (CBD).

The active constituent may comprise nicotine and cannabidiol (CBD).

The active constituent may comprise nicotine, cannabidiol (CBD), and THC (tetrahydrocannabinol).

In some embodiments the slurry comprises no tobacco material but does comprise nicotine. In some such cases, the slurry may comprise from about 1 wt %, 2 wt %, 3 wt % or 4 wt % to about 20 wt %, 15 wt %, 10 wt % or 5 wt % (calculated on a dry weight basis) of nicotine. For example, the slurry may comprise 1-20 wt % or 2-5 wt % of nicotine.

In some cases, the total content of active constituent and/or flavor may be at least about 0.1 wt %, 1 wt %, 5 wt %, 10 wt %, 20 wt %, 25 wt % or 30 wt %. In some cases, the total content of active constituent and/or flavor may be less than about 60 wt %, 50 wt % or 40 wt % (all calculated on a dry weight basis).

In some cases, the total content of tobacco material, nicotine and flavor may be at least about 0.1 wt %, 1 wt %, 5 wt %, 10 wt %, 20 wt %, 25 wt % or 30 wt %. In some cases, the total content of tobacco material, nicotine and flavor may be less than about 60 wt %, 50 wt % or 40 wt % (all calculated on a dry weight basis).

The amorphous solid may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

The inclusion of an acid is particularly preferred in embodiments in which the amorphous solid comprises nicotine. In such embodiments, the presence of an acid may stabilise dissolved species in the slurry from which the amorphous solid is formed. The presence of the acid may reduce or substantially prevent evaporation of nicotine during drying of the slurry, thereby reducing loss of nicotine during manufacturing.

In certain embodiments, the amorphous solid comprises a gelling agent comprising a cellulosic gelling agent and/or a non-cellulosic gelling agent, an active substance and an acid.

The amorphous solid may comprise a colorant. The addition of a colorant may alter the visual appearance of the amorphous solid. The presence of colorant in the amorphous solid may enhance the visual appearance of the amorphous solid and an aerosol-generating material comprising the amorphous solid. By adding a colorant to the amorphous solid, the amorphous solid may be color-matched to other components of the aerosol-generating material or to other components of an article comprising the amorphous solid.

A variety of colorants may be used depending on the desired color of the amorphous solid. The color of amorphous solid may be, for example, white, green, red, purple, blue, brown or black. Other colors are also envisaged. Natural or synthetic colorants, such as natural or synthetic dyes, food-grade colorants and pharmaceutical-grade colorants may be used. In certain embodiments, the colorant s caramel, which may confer the amorphous solid with a brown appearance. In such embodiments, the color of the amorphous solid may be similar to the color of other components (such as tobacco material) in an aerosol-generating material comprising the amorphous solid. In some embodiments, the addition of a colorant to the amorphous solid renders it visually indistinguishable from other components in the aerosol-generating material.

The colorant may be incorporated during the formation of the amorphous solid (e.g. when forming a slurry comprising the materials that form the amorphous solid) or it may be applied to the amorphous solid after its formation (e.g. by spraying it onto the amorphous solid).

In some embodiments, the slurry comprises less than 60 wt % of a filler, such as from 1 wt % to 60 wt %, or 5 wt % to 50 wt %, or 5 wt % to 30 wt %, or 10 wt % to 20 wt % (all calculated on a dry weight basis).

In other embodiments, the slurry comprises less than 20 wt %, suitably less than 10 wt % or less than 5 wt % of a filler. In some cases, the slurry comprises less than 1 wt % of a filler, and in some cases, comprises no filler.

The filler, if present, may comprise one or more inorganic filler materials, such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, cellulose and cellulose derivatives. In particular cases, the amorphous solid comprises no calcium carbonate such as chalk.

In particular embodiments which include filler, the filler is fibrous. For example, the filler may be a fibrous organic filler material such as wood pulp, hemp fibre, cellulose or cellulose derivatives. Without wishing to be bound by theory, it is believed that including fibrous filler in an amorphous solid may increase the tensile strength of the material. This may be particularly advantageous in examples wherein the amorphous solid is provided as a sheet, such as when an amorphous solid sheet circumscribes a rod of aerosol-generating material.

In some embodiments, the slurry does not comprise tobacco fibres. In particular embodiments, the slurry does not comprise fibrous material.

In some cases, the slurry may consist essentially of, or consist of, a gelling agent, an aerosol forming material, a tobacco material and/or a nicotine source, water, and optionally a flavour.

The resulting amorphous solid may have any suitable area density, such as from 30 g/m$^2$ to 120 g/m$^2$, suitably about 30 to 70 g/m$^2$, or about 40 to 60 g/m$^2$. In some embodiments, the resulting amorphous solid may have an area density of from about 80 to 120 g/m$^2$, or from about 70 to 110 g/m$^2$, or particularly from about 90 to 110 g/m$^2$. Such area densities may be particularly suitable where the amorphous solid is included in an article/non-combustible aerosol provision system in sheet form, or as a shredded sheet (described further hereinbelow).

As noted above, further aspects of the invention provide an amorphous solid obtainable or obtained by methods of the first or second aspect, an article for use in a non-combustible aerosol provision system, the article comprising an amorphous solid obtainable or obtained by methods of the first or second aspect, and a non-combustible aerosol provision system comprising the article according to the previous aspect and a non-combustible aerosol provision device, the non-combustible aerosol provision device comprising an aerosol-generation device to generate aerosol from the article when the article is used with the non-combustible aerosol provision device. In some cases, the device includes a heater which is configured to heat the amorphous solid, without burning.

In some cases, the heater may heat, without burning, the amorphous solid to between 120° C. and 350° C. in use. In some cases, the heater may heat, without burning, the amorphous solid to between 140° C. and 250° C. in use. In some cases in use, substantially all of the amorphous solid is less than about 4 mm, 3 mm, 2 mm or 1 mm from the heater. In some cases, the solid is disposed between about 0.010 mm and 2.0 mm from the heater, suitably between about 0.02 mm and 1.0 mm, suitably 0.1 mm to 0.5 mm. These minimum distances may, in some cases, reflect the thickness of a carrier that supports the amorphous solid. In some cases, a surface of the amorphous solid may directly abut the heater.

The heater is configured to heat not burn the amorphous solid. The heater may be, in some cases, an electrically resistive heater such as a thin-film electrically resistive heater. In other cases, the heater may comprise an induction heater or the like. The heater may be a combustible heat source or a chemical heat source which undergoes an exothermic reaction to product heat in use. The non-combustible aerosol provision system may comprise a plurality of heaters. The heater(s) may be powered by a battery.

The non-combustible aerosol provision system may additionally comprise a cooling element and/or a filter. The cooling element, if present, may act or function to cool gaseous or aerosol components. In some cases, it may act to cool gaseous components such that they condense to form an aerosol. It may also act to space the very hot parts of the apparatus from the user. The filter, if present, may comprise any suitable filter known in the art such as a cellulose acetate plug.

In some cases, the non-combustible aerosol provision system may be a heat-not-burn device. That is, it may contain a solid tobacco-containing material (and no liquid aerosol-generating material). In some cases, the amorphous solid may comprise the tobacco material. A heat-not-burn device is disclosed in WO 2015/062983 A2, which is incorporated by reference in its entirety.

In some cases, the non-combustible aerosol provision system may be a hybrid device. That is, it may contain a solid aerosol-generating material and a liquid aerosol-generating material. In some cases, the amorphous solid may comprise nicotine. In some cases, the amorphous solid may comprise a tobacco material. In some cases, the amorphous solid may comprise a tobacco material and a separate nicotine source. The separate aerosol-generating materials may be heated by separate heaters, the same heater or, in one case, a downstream aerosol-generating material may be heated by a hot aerosol which is generated from the upstream aerosol-generating material. A hybrid device is disclosed in WO 2016/135331 A1, which is incorporated by reference in its entirety.

The article for use in a non-combustible aerosol provision system (which may be referred to herein as an article, a cartridge or a consumable) may be adapted for use in a THP, a hybrid device or another aerosol generating device. In some cases, the article may additionally comprise a filter and/or cooling element (which have been described above). In some cases, the article may be circumscribed by a wrapping material such as paper.

The article may additionally comprise ventilation apertures. These may be provided in the sidewall of the article. In some cases, the ventilation apertures may be provided in the filter and/or cooling element. These apertures may allow cool air to be drawn into the article during use, which can mix with the heated volatilized components thereby cooling the aerosol.

The ventilation enhances the generation of visible heated volatilized components from the article when it is heated in use. The heated volatilized components are made visible by the process of cooling the heated volatilized components such that supersaturation of the heated volatilised components occurs. The heated volatilized components then undergo droplet formation, otherwise known as nucleation, and eventually the size of the aerosol particles of the heated volatilized components increases by further condensation of the heated volatilized components and by coagulation of newly formed droplets from the heated volatilized components.

In some cases, the ratio of the cool air to the sum of the heated volatilized components and the cool air, known as the ventilation ratio, is at least 15%. A ventilation ratio of 15% enables the heated volatilized components to be made visible by the method described above. The visibility of the heated volatilized volatilised components enables the user to identify that the volatilized components have been generated and adds to the sensory experience of the smoking experience.

In another example, the ventilation ratio is between 50% and 85% to provide additional cooling to the heated volatilized components. In some cases, the ventilation ratio may be at least 60% or 65%.

In some cases, the amorphous solid may be included in the article/non-combustible aerosol provision system in sheet form. In some cases, the amorphous solid may be included as a planar sheet. In some cases, the amorphous solid may be included as a planar sheet, as a bunched or gathered sheet, as a crimped sheet, or as a rolled sheet (i.e. in the form of a tube). In some such cases, the amorphous solid may be included in an article/non-combustible aerosol provision system as a sheet, such as a sheet circumscribing a rod of aerosol-generating material (e.g. tobacco). In some other cases, the amorphous solid may be formed as a sheet and then shredded and incorporated into the article. In some cases, the shredded sheet may be mixed with cut rag tobacco and incorporated into the article.

In some examples, the amorphous solid in sheet form may have a tensile strength of from around 200 N/m to around 900 N/m. In some examples, such as where the amorphous solid does not comprise a filler, the amorphous solid may have a tensile strength of from 200 N/m to 400 N/m, or 200 N/m to 300 N/m, or about 250 N/m. Such tensile strengths may be particularly suitable for embodiments wherein the amorphous solid is formed as a sheet and then shredded and incorporated into an article. In some examples, such as where the amorphous solid comprises a filler, the amorphous solid may have a tensile strength of from 600 N/m to 900 N/m, or from 700 N/m to 900 N/m, or around 800 N/m. Such tensile strengths may be particularly suitable for embodiments wherein the amorphous solid is included in an article/non-combustible aerosol provision system as a rolled sheet, suitably in the form of a tube.

The non-combustible aerosol provision system may comprise an integrated article and heater, or may comprise a heater device into which the article is inserted in use.

Figure 2:
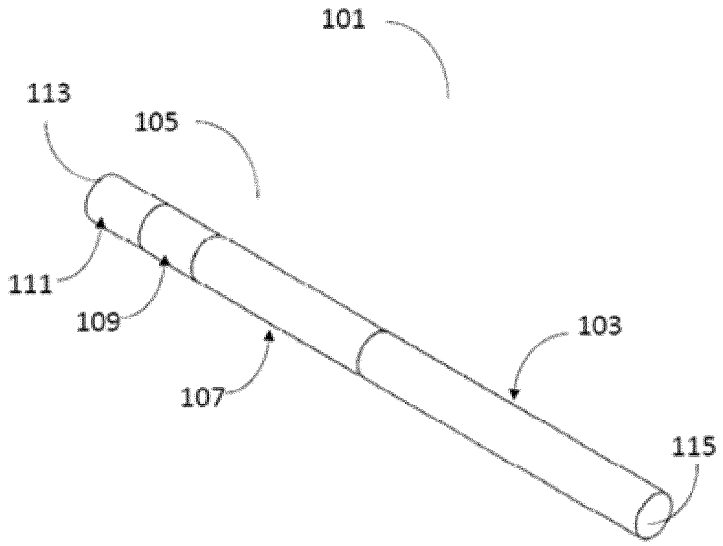
FIG. 2 shows a perspective view of the article of FIG. 1.

Referring to FIGS. 1 and 2, there are shown a partially cut-away section view and a perspective view of an example of an article 101. The article 101 is adapted for use with a device having a power source and a heater. The article 101 of this embodiment is particularly suitable for use with the device 51 shown in FIGS. 5 to 7, described below. In use, the article 101 may be removably inserted into the device shown in FIG. 5 at an insertion point 20 of the device 51.

The article 101 of one example is in the form of a substantially cylindrical rod that includes a body of aerosol-generating material 103 and a filter assembly 105 in the form of a rod. The aerosol-generating material comprises the amorphous solid described herein. In some embodiments, it may be included in sheet form. In some embodiments it may be included in the form of a shredded sheet. In some embodiments, the aerosol-generating material described herein may be incorporated in sheet form and in shredded form.

The filter assembly 105 includes three segments, a cooling segment 107, a filter segment 109 and a mouth end segment 111. The article 101 has a first end 113, also known as a mouth end or a proximal end and a second end 115, also known as a distal end. The body of aerosol-generating material 103 is located towards the distal end 115 of the article 101. In one example, the cooling segment 107 is located adjacent the body of aerosol-generating material 103 between the body of aerosol-generating material 103 and the filter segment 109, such that the cooling segment 107 is in an abutting relationship with the aerosol-generating material 103 and the filter segment 103. In other examples, there may be a separation between the body of aerosol-generating material 103 and the cooling segment 107 and between the body of aerosol-generating material 103 and the filter segment 109. The filter segment 109 is located in between the cooling segment 107 and the mouth end segment 111. The mouth end segment 111 is located towards the proximal end 113 of the article 101, adjacent the filter segment 109. In one example, the filter segment 109 is in an abutting relationship with the mouth end segment 111. In one embodiment, the total length of the filter assembly 105 is between 37 mm and 45 mm, more preferably, the total length of the filter assembly 105 is 41 mm.

In one example, the rod of aerosol-generating material 103 is between 34 mm and 50 mm in length, suitably between 38 mm and 46 mm in length, suitably 42 mm in length.

In one example, the total length of the article 101 is between 71 mm and 95 mm, suitably between 79 mm and 87 mm, suitably 83 mm.

An axial end of the body of aerosol-generating material 103 is visible at the distal end 115 of the article 101. However, in other embodiments, the distal end 115 of the article 101 may comprise an end member (not shown) covering the axial end of the body of aerosol-generating material 103.

The body of aerosol-generating material 103 is joined to the filter assembly 105 by annular tipping paper (not shown), which is located substantially around the circumference of the filter assembly 105 to surround the filter assembly 105 and extends partially along the length of the body of aerosol-generating material 103. In one example, the tipping paper is made of 58GSM standard tipping base paper. In one example the tipping paper has a length of between 42 mm and 50 mm, suitably of 46 mm.

In one example, the cooling segment 107 is an annular tube and is located around and defines an air gap within the cooling segment. The air gap provides a chamber for heated volatilized volatilised components generated from the body of aerosol-generating material 103 to flow. The cooling segment 107 is hollow to provide a chamber for aerosol accumulation yet rigid enough to withstand axial compressive forces and bending moments that might arise during manufacture and whilst the article 101 is in use during insertion into the device 51. In one example, the thickness of the wall of the cooling segment 107 is approximately 0.29 mm.

The cooling segment 107 provides a physical displacement between the aerosol-generating material 103 and the filter segment 109. The physical displacement provided by the cooling segment 107 will provide a thermal gradient across the length of the cooling segment 107. In one example the cooling segment 107 is configured to provide a temperature differential of at least 40 degrees Celsius between a heated volatilized component entering a first end of the cooling segment 107 and a heated volatilized component exiting a second end of the cooling segment 107. In one example the cooling segment 107 is configured to provide a temperature differential of at least 60° C. between a heated volatilized volatilised component entering a first end of the cooling segment 107 and a heated volatilized volatilised component exiting a second end of the cooling segment 107. This temperature differential across the length of the cooling element 107 protects the temperature sensitive filter segment 109 from the high temperatures of the aerosol-generating material 103 when it is heated by the device 51. If the physical displacement was not provided between the filter segment 109 and the body of aerosol-generating material 103 and the heating elements of the device 51, then the temperature sensitive filter segment may 109 become damaged in use, so it would not perform its required functions as effectively.

In one example the length of the cooling segment 107 is at least 15 mm. In one example, the length of the cooling segment 107 is between 20 mm and 30 mm, more particularly 23 mm to 27 mm, more particularly 25 mm to 27 mm, suitably 25 mm.

The cooling segment 107 is made of paper, which means that it is comprised of a material that does not generate compounds of concern, for example, toxic compounds when in use adjacent to the heater of the device 51. In one example, the cooling segment 107 is manufactured from a spirally wound paper tube which provides a hollow internal chamber yet maintains mechanical rigidity. Spirally wound paper tubes are able to meet the tight dimensional accuracy requirements of high-speed manufacturing processes with respect to tube length, outer diameter, roundness and straightness.

In another example, the cooling segment 107 is a recess created from stiff plug wrap or tipping paper. The stiff plug wrap or tipping paper is manufactured to have a rigidity that is sufficient to withstand the axial compressive forces and bending moments that might arise during manufacture and whilst the article 101 is in use during insertion into the device 51.

The filter segment 109 may be formed of any filter material sufficient to remove one or more volatilized compounds from heated volatilized components from the aerosol-generating material. In one example the filter segment 109 is made of a mono-acetate material, such as cellulose acetate. The filter segment 109 provides cooling and irritation-reduction from the heated volatilized components without depleting the quantity of the heated volatilized components to an unsatisfactory level for a user.

In some embodiments, a capsule (not illustrated) may be provided in filter segment 109. It may be disposed substantially centrally in the filter segment 109, both across the filter segment 109 diameter and along the filter segment 109 length. In other cases, it may be offset in one or more dimension. The capsule may in some cases, where present, contain a volatile component such as a flavorant or aerosol forming material.

The density of the cellulose acetate tow material of the filter segment 109 controls the pressure drop across the filter segment 109, which in turn controls the draw resistance of the article 101. Therefore the selection of the material of the filter segment 109 is important in controlling the resistance to draw of the article 101. In addition, the filter segment performs a filtration function in the article 101.

In one example, the filter segment 109 is made of a 8Y15 grade of filter tow material, which provides a filtration effect on the heated volatilized material, whilst also reducing the size of condensed aerosol droplets which result from the heated volatilized material.

The presence of the filter segment 109 provides an insulating effect by providing further cooling to the heated volatilized components that exit the cooling segment 107. This further cooling effect reduces the contact temperature of the user's lips on the surface of the filter segment 109.

In one example, the filter segment 109 is between 6 mm to 10 mm in length, suitably 8 mm.

The mouth end segment 111 is an annular tube and is located around and defines an air gap within the mouth end segment 111. The air gap provides a chamber for heated volatilized components that flow from the filter segment 109. The mouth end segment 111 is hollow to provide a chamber for aerosol accumulation yet rigid enough to withstand axial compressive forces and bending moments that might arise during manufacture and whilst the article is in use during insertion into the device 51. In one example, the thickness of the wall of the mouth end segment 111 is approximately 0.29 mm. In one example, the length of the mouth end segment 111 is between 6 mm to 10 mm, suitably 8 mm.

The mouth end segment 111 may be manufactured from a spirally wound paper tube which provides a hollow internal chamber yet maintains critical mechanical rigidity.

Spirally wound paper tubes are able to meet the tight dimensional accuracy requirements of high-speed manufacturing processes with respect to tube length, outer diameter, roundness and straightness.

The mouth end segment 111 provides the function of preventing any liquid condensate that accumulates at the exit of the filter segment 109 from coming into direct contact with a user.

It should be appreciated that, in one example, the mouth end segment 111 and the cooling segment 107 may be formed of a single tube and the filter segment 109 is located within that tube separating the mouth end segment 111 and the cooling segment 107.

Figure 3:
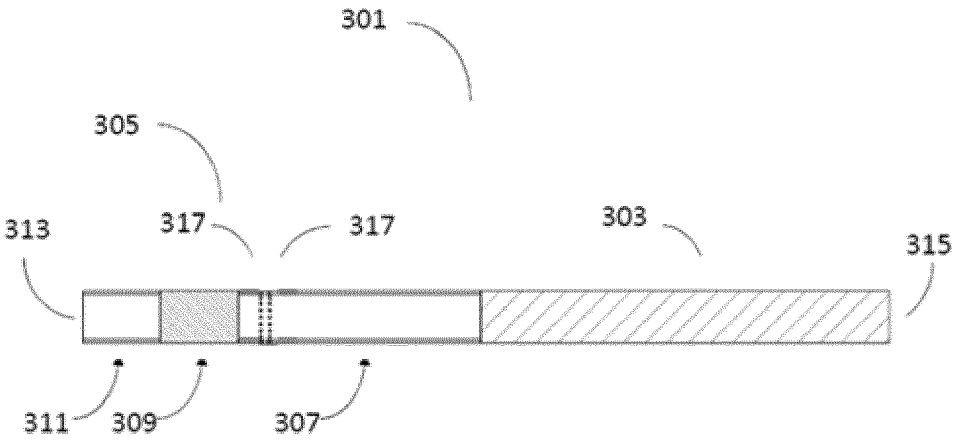
FIG. 3 shows a sectional elevation of an example of an article.
Figure 4:
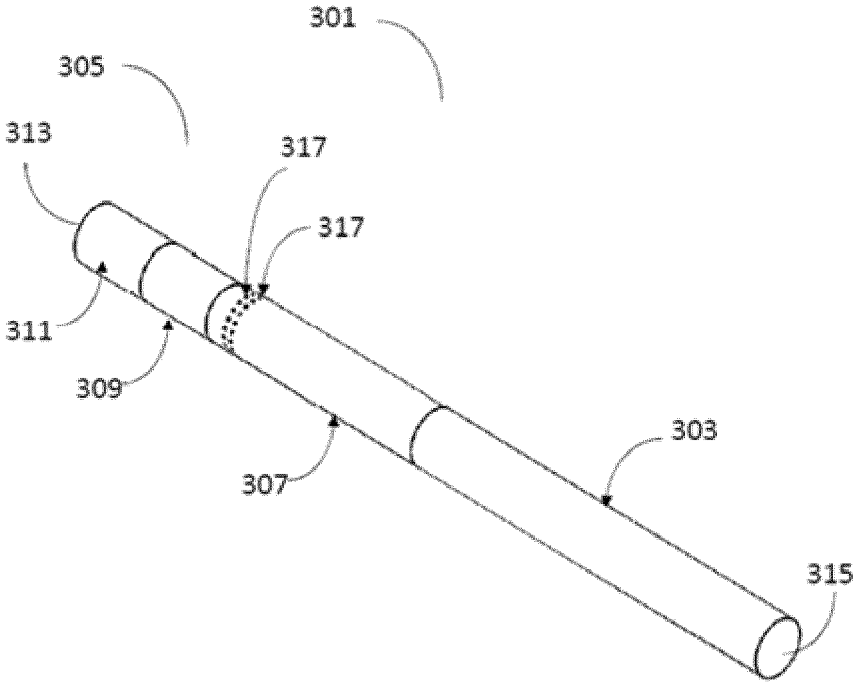
FIG. 4 shows a perspective view of the article of FIG. 3.

Referring to FIGS. 3 and 4, there are shown a partially cut-away section and perspective views of an example of an article 301. The reference signs shown in FIGS. 3 and 4 are equivalent to the reference signs shown in FIGS. 1 and 2, but with an increment of 200.

In the example of the article 301 shown in FIGS. 3 and 4, a ventilation region 317 is provided in the article 301 to enable air to flow into the interior of the article 301 from the exterior of the article 301. In one example the ventilation region 317 takes the form of one or more ventilation holes 317 formed through the outer layer of the article 301. The ventilation holes may be located in the cooling segment 307 to aid with the cooling of the article 301. In one example, the ventilation region 317 comprises one or more rows of holes, and preferably, each row of holes is arranged circumferentially around the article 301 in a cross-section that is substantially perpendicular to a longitudinal axis of the article 301.

In one example, there are between one to four rows of ventilation holes to provide ventilation for the article 301. Each row of ventilation holes may have between 12 to 36 ventilation holes 317. The ventilation holes 317 may, for example, be between 100 to 500 μm in diameter. In one example, an axial separation between rows of ventilation holes 317 is between 0.25 mm and 0.75 mm, suitably 0.5 mm.

In one example, the ventilation holes 317 are of uniform size. In another example, the ventilation holes 317 vary in size. The ventilation holes can be made using any suitable technique, for example, one or more of the following techniques: laser technology, mechanical perforation of the cooling segment 307 or pre-perforation of the cooling segment 307 before it is formed into the article 301. The ventilation holes 317 are positioned so as to provide effective cooling to the article 301.

In one example, the rows of ventilation holes 317 are located at least 11 mm from the proximal end 313 of the article, suitably between 17 mm and 20 mm from the proximal end 313 of the article 301. The location of the ventilation holes 317 is positioned such that user does not block the ventilation holes 317 when the article 301 is in use.

Figure 6:
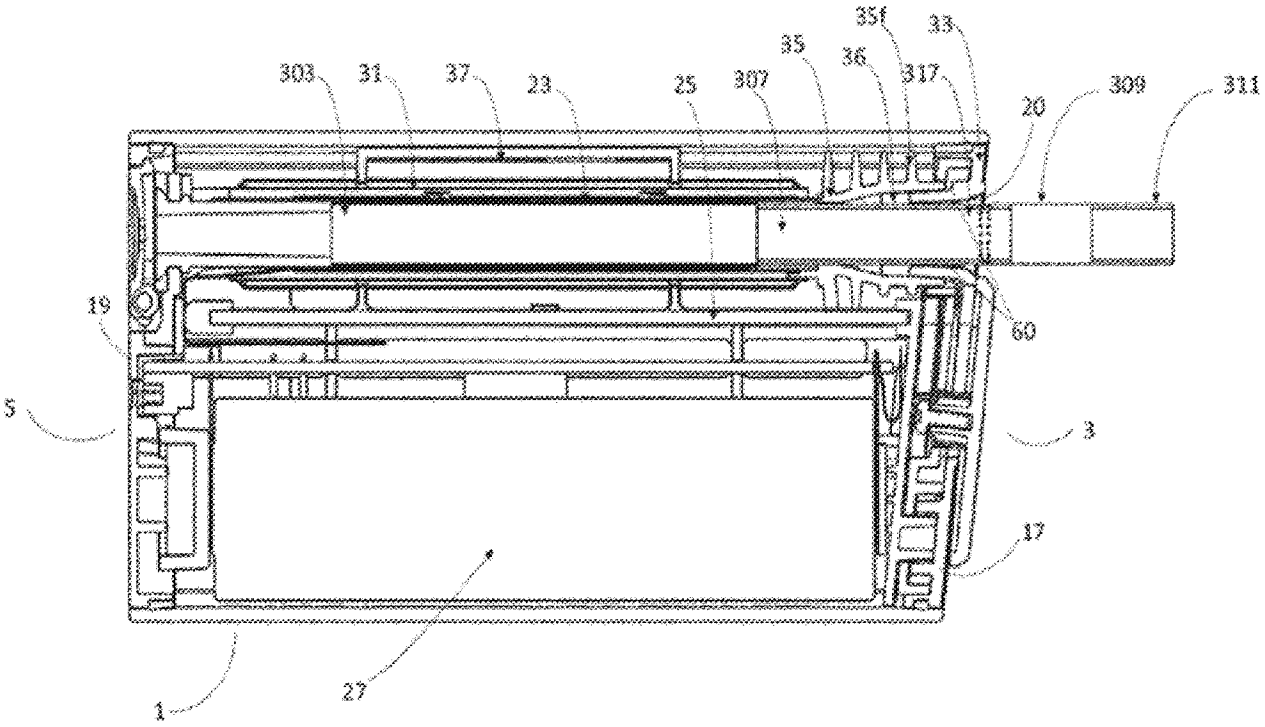
FIG. 6 shows a section view of an example of a non-combustible aerosol provision system.
Figure 7:
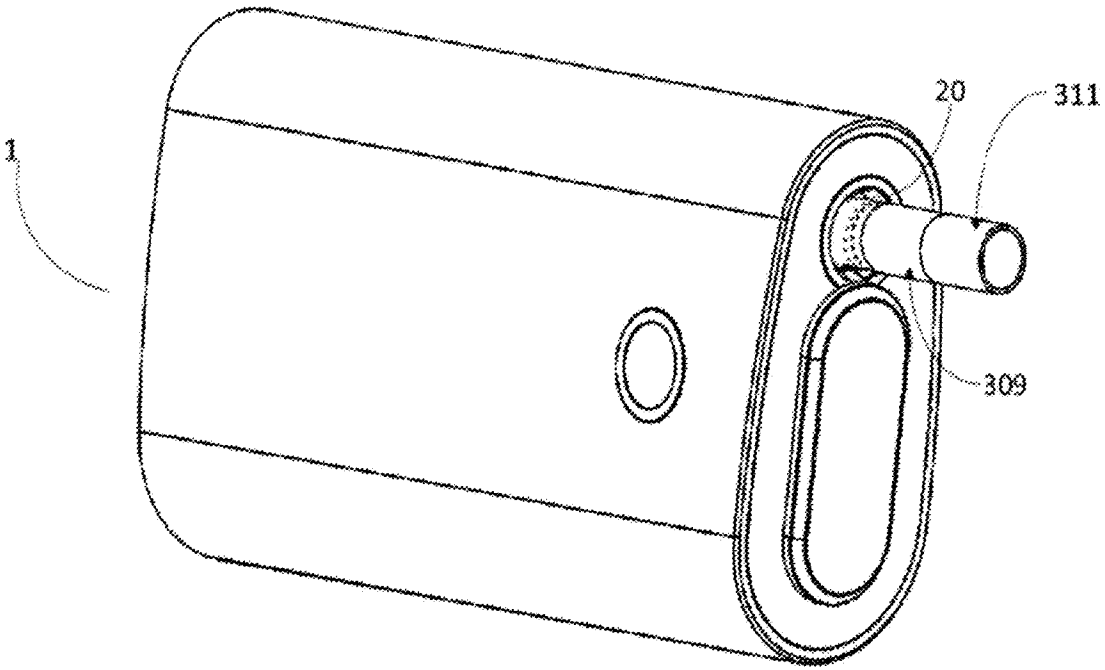
FIG. 7 shows a perspective view of an example of a non-combustible aerosol provision system.

Providing the rows of ventilation holes between 17 mm and 20 mm from the proximal end 313 of the article 301 enables the ventilation holes 317 to be located outside of the device 51, when the article 301 is fully inserted in the device 51, as can be seen in FIGS. 6 and 7. By locating the ventilation holes outside of the device, non-heated air is able to enter the article 301 through the ventilation holes from outside the device 51 to aid with the cooling of the article 301.

The length of the cooling segment 307 is such that the cooling segment 307 will be partially inserted into the device 51, when the article 301 is fully inserted into the device 51. The length of the cooling segment 307 provides a first function of providing a physical gap between the heater arrangement of the device 51 and the heat sensitive filter arrangement 309, and a second function of enabling the ventilation holes 317 to be located in the cooling segment, whilst also being located outside of the device 51, when the article 301 is fully inserted into the device 51. As can be seen from FIGS. 6 and 7, the majority of the cooling element 307 is located within the device 51. However, there is a portion of the cooling element 307 that extends out of the device 51. It is in this portion of the cooling element 307 that extends out of the device 51 in which the ventilation holes 317 are located.

Figure 5:
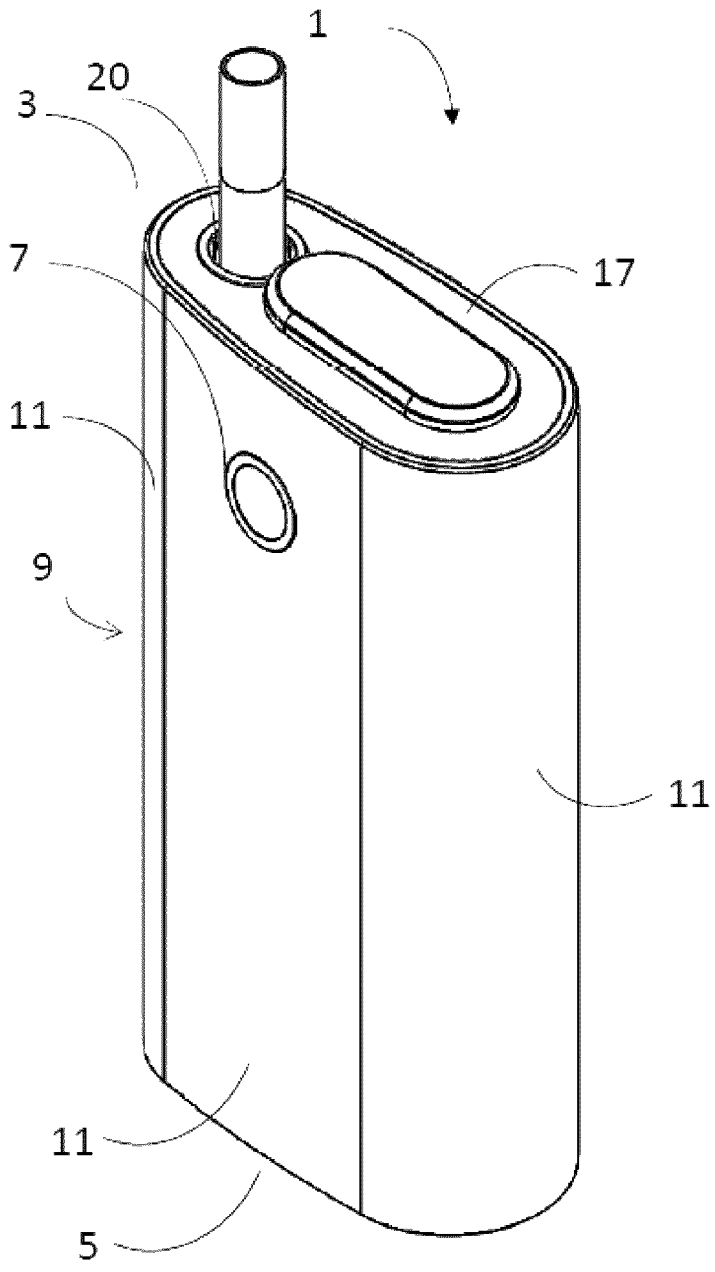
FIG. 5 shows a perspective view of an example of a non-combustible aerosol provision system.

Referring now to FIGS. 5 to 7 in more detail, there is shown an example of a device 51 arranged to heat aerosol-generating material to volatilize at least one component of said aerosol-generating material, typically to form an aerosol which can be inhaled. The device 51 is a heating device which releases compounds by heating, but not burning, the aerosol-generating material.

A first end 53 is sometimes referred to herein as the mouth or proximal end 53 of the device 51 and a second end 55 is sometimes referred to herein as the distal end 55 of the device 51. The device 51 has an on/off button 57 to allow the device 51 as a whole to be switched on and off as desired by a user.

The device 51 comprises a housing 59 for locating and protecting various internal components of the device 51. In the example shown, the housing 59 comprises a uni-body sleeve 11 that encompasses the perimeter of the device 51, capped with a top panel 17 which defines generally the 'top' of the device 51 and a bottom panel 19 which defines generally the 'bottom' of the device 51. In another example the housing comprises a front panel, a rear panel and a pair of opposite side panels in addition to the top panel 17 and the bottom panel 19.

The top panel 17 and/or the bottom panel 19 may be removably fixed to the uni-body sleeve 11, to permit easy access to the interior of the device 51, or may be "permanently" fixed to the uni-body sleeve 11, for example to deter a user from accessing the interior of the device 51. In an example, the panels 17 and 19 are made of a plastics material, including for example glass-filled nylon formed by injection moulding, and the uni-body sleeve 11 is made of aluminium, though other materials and other manufacturing processes may be used.

The top panel 17 of the device 51 has an opening 20 at the mouth end 53 of the device 51 through which, in use, the article 101, 301 including the aerosol-generating material may be inserted into the device 51 and removed from the device 51 by a user.

The housing 59 has located or fixed therein a heater arrangement 23, control circuitry 25 and a power source 27. In this example, the heater arrangement 23, the control circuitry 25 and the power source 27 are laterally adjacent (that is, adjacent when viewed from an end), with the control circuitry 25 being located generally between the heater arrangement 23 and the power source 27, though other locations are possible.

The control circuitry 25 may include a controller, such as a microprocessor arrangement, configured and arranged to control the heating of the aerosol-generating material in the article 101, 301 as discussed further below.

The power source 27 may be for example a battery, which may be a rechargeable battery or a non-rechargeable battery. Examples of suitable batteries include for example a lithium-ion battery, a nickel battery (such as a nickel—cadmium battery), an alkaline battery and/or the like. The battery 27 is electrically coupled to the heater arrangement 23 to supply electrical power when required and under control of the control circuitry 25 to heat the aerosol-generating material in the article (as discussed, to volatilize the aerosol-generating material without causing the aerosol-generating material to burn).

An advantage of locating the power source 27 laterally adjacent to the heater arrangement 23 is that a physically large power source 25 may be used without causing the device 51 as a whole to be unduly lengthy. As will be understood, in general a physically large power source 25 has a higher capacity (that is, the total electrical energy that can be supplied, often measured in Amp-hours or the like) and thus the battery life for the device 51 can be longer.

In one example, the heater arrangement 23 is generally in the form of a hollow cylindrical tube, having a hollow interior heating chamber 29 into which the article 101, 301 comprising the aerosol-generating material is inserted for heating in use. Different arrangements for the heater arrangement 23 are possible. For example, the heater arrangement 23 may comprise a single heating element or may be formed of plural heating elements aligned along the longitudinal axis of the heater arrangement 23. The or each heating element may be annular or tubular, or at least part-annular or part-tubular around its circumference. In an example, the or each heating element may be a thin film heater. In another example, the or each heating element may be made of a ceramics material. Examples of suitable ceramics materials include alumina and aluminium nitride and silicon nitride ceramics, which may be laminated and sintered. Other heating arrangements are possible, including for example inductive heating, infrared heater elements, which heat by emitting infrared radiation, or resistive heating elements formed by for example a resistive electrical winding.

In one particular example, the heater arrangement 23 is supported by a stainless steel support tube and comprises a polyimide heating element. The heater arrangement 23 is dimensioned so that substantially the whole of the body of aerosol-generating material 103, 303 of the article 101, 301 is inserted into the heater arrangement 23 when the article 101, 301 is inserted into the device 51.

The or each heating element may be arranged so that selected zones of the aerosol-generating material can be independently heated, for example in turn (over time, as discussed above) or together (simultaneously) as desired.

The heater arrangement 23 in this example is surrounded along at least part of its length by a thermal insulator 31. The insulator 31 helps to reduce heat passing from the heater arrangement 23 to the exterior of the device 51. This helps to keep down the power requirements for the heater arrangement 23 as it reduces heat losses generally. The insulator 31 also helps to keep the exterior of the device 51 cool during operation of the heater arrangement 23. In one example, the insulator 31 may be a double-walled sleeve which provides a low pressure region between the two walls of the sleeve. That is, the insulator 31 may be for example a "vacuum" tube, i.e. a tube that has been at least partially evacuated so as to minimise heat transfer by conduction and/or convection. Other arrangements for the insulator 31 are possible, including using heat insulating materials, including for example a suitable foam-type material, in addition to or instead of a double-walled sleeve.

The housing 59 may further comprise various internal support structures 37 for supporting all internal components, as well as the heating arrangement 23.

The device 51 further comprises a collar 33 which extends around and projects from the opening 20 into the interior of the housing 59 and a generally tubular chamber 35 which is located between the collar 33 and one end of the vacuum sleeve 31. The chamber 35 further comprises a cooling structure **35*f*, which in this example, comprises a plurality of cooling fins 35*f* spaced apart along the outer surface of the chamber 35, and each arranged circumferentially around outer surface of the chamber 35. There is an air gap 36 between the hollow chamber 35 and the article 101, 301 when it is inserted in the device 51 over at least part of the length of the hollow chamber 35. The air gap 36 is around all of the circumference of the article 101, 301 over at least part of the cooling segment 307**.

The collar 33 comprises a plurality of ridges 60 arranged circumferentially around the periphery of the opening 20 and which project into the opening 20. The ridges 60 take up space within the opening 20 such that the open span of the opening 20 at the locations of the ridges 60 is less than the open span of the opening 20 at the locations without the ridges 60. The ridges 60 are configured to engage with an article 101, 301 inserted into the device to assist in securing it within the device 51. Open spaces (not shown in the Figures) defined by adjacent pairs of ridges 60 and the article 101, 301 form ventilation paths around the exterior of the article 101, 301. These ventilation paths allow hot vapours that have escaped from the article 101, 301 to exit the device 51 and allow cooling air to flow into the device 51 around the article 101, 301 in the air gap 36.

In operation, the article 101, 301 is removably inserted into an insertion point 20 of the device 51, as shown in FIGS. 5 to 7. Referring particularly to FIG. 6, in one example, the body of aerosol-generating material 103, 303, which is located towards the distal end 115, 315 of the article 101, 301, is entirely received within the heater arrangement 23 of the device 51. The proximal end 113, 313 of the article 101, 301 extends from the device 51 and acts as a mouthpiece assembly for a user.

In operation, the heater arrangement 23 will heat the article 101, 301 to volatilize at least one component of the aerosol-generating material from the body of aerosol-generating material 103, 303.

The primary flow path for the heated volatilized components from the body of aerosol-generating material 103, 303 is axially through the article 101, 301, through the chamber inside the cooling segment 107, 307, through the filter segment 109, 309, through the mouth end segment 111, 313 to the user. In one example, the temperature of the heated volatilized components that are generated from the body of aerosol-generating material is between 60° C. and 250° C., which may be above the acceptable inhalation temperature for a user. As the heated volatilized component travels through the cooling segment 107, 307, it will cool and some volatilized components will condense on the inner surface of the cooling segment 107, 307.

In the examples of the article 301 shown in FIGS. 3 and 4, cool air will be able to enter the cooling segment 307 via the ventilation holes 317 formed in the cooling segment 307. This cool air will mix with the heated volatilized components to provide additional cooling to the heated volatilized components.

Exemplary Embodiments

Description of a number of exemplary embodiments follows. Each refers to an amorphous solid obtainable by the methods of the invention. Where the amorphous solid composition is given (DWB), the slurry may have the same DWB composition as the amorphous solid (i.e. it includes additional water only).

In some embodiments, the amorphous solid comprises menthol.

Particular embodiments comprising a menthol-containing amorphous solid may be particularly suitable for including in an article/non-combustible aerosol provision system as a shredded sheet. In these embodiments, the amorphous solid may have the following composition (DWB): gelling agent (preferably comprising alginate, more preferably comprising a combination of alginate and pectin) in an amount of from about 20 wt % to about 40 wt %, or about 25 wt % to 35 wt %; menthol in an amount of from about 35 wt % to about 60 wt %, or from about 40 wt % to 55 wt %; aerosol forming material (preferably comprising glycerol) in an amount of from about 10 wt % to about 30 wt %, or from about 15 wt % to about 25 wt % (DWB).

In one embodiment, the amorphous solid comprises about 32-33 wt % of an alginate/pectin gelling agent blend; about 47-48 wt % menthol flavorant; and about 19-20 wt % glycerol aerosol forming material (DWB).

The amorphous solid of these embodiments may have any suitable water content. For example, the amorphous solid may have a water content of from about 2 wt % to about 10 wt %, or from about 5 wt % to about 8 wt %, or about 6 wt %.

As noted above, the amorphous solid of these embodiments may be included in an article/non-combustible aerosol provision system as a shredded sheet. The shredded sheet may be provided in the article/non-combustible aerosol provision system blended with cut tobacco. Alternatively, the amorphous solid may be provided as a non-shredded sheet. Suitably, the shredded or non-shredded sheet has a thickness of from about 0.015 mm to about 1 mm, preferably from about 0.02 mm to about 0.07 mm.

Particular embodiments of the menthol-containing amorphous solid may be particularly suitable for including in an article/non-combustible aerosol provision system as a sheet, such as a sheet circumscribing a rod of aerosol-generating material (e.g. tobacco). In these embodiments, the amorphous solid may have the following composition (DWB): gelling agent (preferably comprising alginate, more preferably comprising a combination of alginate and pectin) in an amount of from about 5 wt % to about 40 wt %, or about 10 wt % to 30 wt %; menthol in an amount of from about 10 wt % to about 50 wt %, or from about 15 wt % to 40 wt %; aerosol forming material (preferably comprising glycerol) in an amount of from about 5 wt % to about 40 wt %, or from about 10 wt % to about 35 wt %; and optionally filler in an amount of up to 60 wt %—for example, in an amount of from 5 wt % to 20 wt %, or from about 40 wt % to 60 wt % (DWB).

In one of these embodiments, the amorphous solid comprises about 11 wt % of an alginate/pectin gelling agent blend, about 56 wt % woodpulp filler, about 18% menthol flavorant and about 15 wt % glycerol (DWB).

In another of these embodiments, the amorphous solid comprises about 22 wt % of an alginate/pectin gelling agent blend, about 12 wt % woodpulp filler, about 36% menthol flavorant and about 30 wt % glycerol (DWB).

As noted above, the amorphous solid of these embodiments may be included as a sheet. In one embodiment, the sheet is provided on a carrier comprising paper. In one embodiment, the sheet is provided on a carrier comprising metal foil, suitably aluminium metal foil. In this embodiment, the amorphous solid may abut the metal foil. In one embodiment, the sheet forms part of a laminate material with a layer (preferably comprising paper) attached to a top and bottom surface of the sheet. Suitably, the sheet of amorphous solid has a thickness of from about 0.015 mm to about 1 mm.

In some embodiments, the amorphous solid comprises a flavorant which does not comprise menthol. In these embodiments, the amorphous solid may have the following composition (DWB): gelling agent (preferably comprising alginate) in an amount of from about 5 to about 40 wt %, or from about 10 wt % to about 35 wt %, or from about 20 wt % to about 35 wt %; flavorant in an amount of from about 0.1 wt % to about 40 wt %, of from about 1 wt % to about 30 wt %, or from about 1 wt % to about 20 wt %, or from about 5 wt % to about 20 wt %; aerosol forming material (preferably comprising glycerol) in an amount of from 15 wt % to 75 wt %, or from about 30 wt % to about 70 wt %, or from about 50 wt % to about 65 wt %; and optionally filler (suitably woodpulp) in an amount of less than about 60 wt %, or about 20 wt %, or about 10 wt %, or about 5 wt % (preferably the amorphous solid does not comprise filler) (DWB).

In one of these embodiments, the amorphous solid comprises about 27 wt % alginate gelling agent, about 14 wt % flavorant and about 57 wt % glycerol aerosol forming material (DWB).

In another of these embodiments, the amorphous solid comprises about 29 wt % alginate gelling agent, about 9 wt % flavorant and about 60 wt % glycerol (DWB).

The amorphous solid of these embodiments may be included in an article/non-combustible aerosol provision system as a shredded sheet, optionally blended with cut tobacco. Alternatively, the amorphous solid of these embodiments may be included in an article/assembly as a sheet, such as a sheet circumscribing a rod of aerosol-generating material (e.g. tobacco). Alternatively, the amorphous solid of these embodiments may be included in an article/non-combustible aerosol provision system as a layer portion disposed on a carrier.

In some embodiments, the amorphous solid comprises tobacco extract. In these embodiments, the amorphous solid may have the following composition (DWB): gelling agent (preferably comprising alginate) in an amount of from about 5 wt % to about 40 wt %, or about 10 wt % to 30 wt %, or about 15 wt % to about 25 wt %; tobacco extract in an amount of from about 30 wt % to about 60 wt %, or from about 40 wt % to 55 wt %, or from about 45 wt % to about 50 wt %; aerosol forming material (preferably comprising glycerol) in an amount of from about 10 wt % to about 50 wt %, or from about 20 wt % to about 40 wt %, or from about 25 wt % to about 35 wt % (DWB).

In one embodiment, the amorphous solid comprises about 20 wt % alginate gelling agent, about 48 wt % Virginia tobacco extract and about 32 wt % glycerol (DWB).

The amorphous solid of these embodiments may have any suitable water content. For example, the amorphous solid may have a water content of from about 5 wt % to about 15 wt %, or from about 7 wt % to about 13 wt %, or about 10 wt %.

The amorphous solid of these embodiments may be included in an article/non-combustible aerosol provision system as a shredded sheet, optionally blended with cut tobacco.

Alternatively, the amorphous solid of these embodiments may be included in an article/non-combustible aerosol provision system as a sheet, such as a sheet circumscribing a rod of aerosol-generating material (e.g. tobacco). Alternatively, the amorphous solid of these embodiments may be included in an article/non-combustible aerosol provision system as a layer portion disposed on a carrier. Suitably, in any of these embodiments, the amorphous solid has a thickness of from about 50 μm to about 200 μm, or about 50 μm to about 100 μm, or about 60 μm to about 90 μm, suitably about 77 μm.

The slurry for forming this amorphous solid may also form part of the invention. In some cases, the slurry may have an elastic modulus of from about 5 to 1200 Pa (also referred to as storage modulus); in some cases, the slurry may have a viscous modulus of about 5 to 600 Pa (also referred to as loss modulus).

DEFINITIONS

The active constituent as used herein may be a physiologically active material, which is a material intended to achieve or enhance a physiological response. The active constituent may for example be selected from nutraceuticals, nootropics, psychoactives. The active constituent may be naturally occurring or synthetically obtained. The active constituent may comprise for example nicotine, caffeine, taurine, theine, vitamins such as B6 or B12 or C, melatonin, cannabinoids, or constituents, derivatives, or combinations thereof. The active constituent may comprise one or more constituents, derivatives or extracts of tobacco, cannabis or another botanical.

In some embodiments, the active constituent comprises nicotine.

In some embodiments, the active constituent comprises caffeine, melatonin or vitamin B12.

As noted herein, the active constituent may comprise one or more constituents, derivatives or extracts of cannabis, such as one or more cannabinoids or terpenes.

Cannabinoids are a class of natural or synthetic chemical compounds which act on cannabinoid receptors (i.e., CB1 and CB2) in cells that repress neurotransmitter release in the brain. Cannabinoids may be naturally occurring (phytocannabinoids) from plants such as cannabis, from animals (endocannabinoids), or artificially manufactured (synthetic cannabinoids). Cannabis species express at least 85 different phytocannabinoids, and are divided into subclasses, including cannabigerols, cannabichromenes, cannabidiols, tetrahydrocannabinols, cannabinols and cannabinodiols, and other cannabinoids. Cannabinoids found in cannabis include, without limitation: cannabigerol (CBG), cannabichromene (CBC), cannabidiol (CBD), tetrahydrocannabinol (THC), cannabinol (CBN), cannabinodiol (CBDL), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabinerolic acid, cannabidiolic acid (CBDA), Cannabinol propyl variant (CBNV), cannabitriol (CBO), tetrahydrocannabmolic acid (THCA), and tetrahydrocannabivarinic acid (THCV A).

As noted herein, the active constituent may comprise or be derived from one or more botanicals or constituents, derivatives or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arvensis, Mentha* c.v., *Mentha niliaca, Mentha piperita, Mentha piperita citrata* c.v., *Mentha piperita* c.v., *Mentha spicata crispa, Mentha cordifolia, Mentha longifolia, Mentha suaveolens variegata, Mentha pulegium, Mentha spicata* c.v. and *Mentha suaveolens.*

In some embodiments, the active constituent comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The active constituent may comprise one or more cannabinoid compounds selected from the group consisting of cannabidiol (CBD) and THC (tetrahydrocannabinol).

The active constituent may comprise cannabidiol (CBD).

The active constituent may comprise nicotine and cannabidiol (CBD).

The active constituent may comprise nicotine, cannabidiol (CBD), and THC (tetrahydrocannabinol).

In some embodiments, the botanical is selected from eucalyptus, star anise, cocoa and hemp.

In some embodiments, the botanical is selected from rooibos and fennel.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

The flavor may suitably comprise one or more mint-flavors suitably a mint oil from any species of the genus *Mentha*. The flavor may suitably comprise, consist essentially of or consist of menthol.

In some embodiments, the flavor comprises menthol, spearmint and/or peppermint.

In some embodiments, the flavor comprises flavor components of cucumber, blueberry, citrus fruits and/or redberry.

In some embodiments, the flavor comprises eugenol.

In some embodiments, the flavor comprises flavor components extracted from tobacco.

In some embodiments, the flavor comprises flavor components extracted from cannabis.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucalyptol, WS-3.

As used herein, the term "aerosol forming material" refers to an agent that promotes the generation of an aerosol. An aerosol forming material may promote the generation of an aerosol by promoting an initial vaporization and/or the condensation of a gas to an inhalable solid and/or liquid aerosol.

Suitable aerosol forming materials include, but are not limited to: a polyol such as erythritol, sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. The aerosol forming material may suitably have a composition that does not dissolve menthol. The aerosol forming material may suitably comprise, consist essentially of or consist of glycerol.

In some embodiments, the aerosol forming material comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate.

As used herein, the term "tobacco material" refers to any material comprising tobacco or derivatives thereof. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

All percentages by weight described herein (denoted wt %) are calculated on a dry weight basis, unless explicitly stated otherwise. All weight ratios are also calculated on a dry weight basis. A weight quoted on a dry weight basis refers to the whole of the extract or slurry or material, other than the water, and may include components which by themselves are liquid at room temperature and pressure, such as glycerol. Conversely, a weight percentage quoted on a wet weight basis refers to all components, including water.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A method of making an amorphous solid comprising:

(a) forming a slurry comprising:

0.5-60 wt % of a gelling agent;

5-80 wt % of an aerosol forming material; and 0-60 wt % of an active constituent and/or flavorant;

wherein these weights are calculated on a dry weight basis;

(b) shaping the slurry on a support material, wherein the slurry has a bottom surface proximal to the support material, and a top surface opposite the bottom surface;

(c) setting the slurry to form a gel with bottom and top surfaces corresponding to the bottom and top surfaces of the slurry; and (d) drying the gel to form an amorphous solid;

wherein the drying comprises a first period of supplying heat to the bottom surface of the gel and a second period of supplying heat to the top surface of the gel.

2. A method according to claim 1, wherein the support material is a thermally-conductive support material, and wherein the first period comprises heating the thermally-conductive support material to at least 100° C.

3. A method according to claim 1, wherein the thermally-conductive support material is a metallic band.

4. A method according to claim 1, wherein the second period comprises flowing air over the gel, wherein the air temperature is in the range of about 80° C. to about 140° C., for a period of less than 60 minutes.

5. A method according to claim 1, wherein the drying comprises (di) the first period of supplying heat to the bottom surface of the gel, (dii) the second period of supplying heat to the top surface of the gel, and (diii) a third period of supplying heat to the bottom surface of the gel;

wherein (di) and (dii) occur simultaneously or sequentially and (diii) occurs after (dii) and (dii) have concluded.

6. A method according to claim 5, wherein the support material is a thermally-conductive support material, and wherein the first period comprises heating the thermally-conductive support material to at least 100° C. and wherein the third period comprises heating the thermally-conductive support material to at least 100° C.

7. A method according to claim 1, wherein the drying removes 50-95 wt % (WWB) of water in the slurry.

8. A method according to claim 1, wherein the resulting amorphous solid comprises from about 1 wt % to about 15 wt % water, calculated on a wet weight basis.

9. A method according to claim 1, wherein the shaping comprises forming a layer of the slurry, wherein the layer has a thickness of less than about 4 mm.

10. A method according to claim 9, wherein the thickness of the layer is in the range of about 1 mm to about 3 mm, suitably about 1.5 mm to about 2.5 mm.

11. A method according to claim 9, wherein the drying results in an amorphous solid which has a thickness that is between about 5% and 20% of the thickness of the layer.

12. A method according to claim 1, wherein a carrier is provided on the support material and the shaping the slurry comprises shaping the slurry on the carrier.

13. A method according to claim 1, wherein the slurry comprises 10-60 wt % of the active constituent and/or flavourant.

14. A method according to claim 1, wherein the gelling agent is selected from pectins, alginates and mixtures thereof.

15. A method according to claim 1, wherein the aerosol forming material is selected from erythritol, propylene glycol, glycerol and mixtures thereof.

* * * * *